US012004639B2

(12) United States Patent
Berhault et al.

(10) Patent No.: US 12,004,639 B2
(45) Date of Patent: Jun. 11, 2024

(54) APPLICATOR FOR APPLYING A PRODUCT TO THE EYELASHES

(71) Applicant: L'OREAL, Paris (FR)

(72) Inventors: Alain Berhault, Clichy (FR); Eric Caulier, Clichy (FR)

(73) Assignee: L'OREAL, Paris (FR)

( * ) Notice: Subject to any disclaimer, the term of this patent is extended or adjusted under 35 U.S.C. 154(b) by 414 days.

(21) Appl. No.: 16/613,348

(22) PCT Filed: May 11, 2018

(86) PCT No.: PCT/EP2018/062224

§ 371 (c)(1),
(2) Date: Nov. 13, 2019

(87) PCT Pub. No.: WO2018/210695

PCT Pub. Date: Nov. 22, 2018

(65) Prior Publication Data

US 2020/0187634 A1 Jun. 18, 2020

(30) Foreign Application Priority Data

May 16, 2017 (FR) ..... 1754317

(51) Int. Cl.

| | |
|---|---|
| ***A46B 9/02*** | (2006.01) |
| ***A45D 40/26*** | (2006.01) |
| ***A46B 3/18*** | (2006.01) |

(52) U.S. Cl.

CPC ..... *A46B 9/021* (2013.01); *A45D 40/265* (2013.01); *A46B 3/18* (2013.01); *A46B 2200/1053* (2013.01)

(58) Field of Classification Search

CPC .. A46B 9/00; A46B 9/02; A46B 9/021; A46B 9/025; A46B 9/026; A46B 9/028;

(Continued)

(56) References Cited

U.S. PATENT DOCUMENTS

| | | | | |
|---|---|---|---|---|
| 6,408,857 | B1 | 6/2002 | Neuner | |
| 2008/0083421 | A1* | 4/2008 | Malvar | A46D 1/00 132/218 |
| 2008/0245382 | A1* | 10/2008 | Marciniak-Davoult | A45D 40/265 132/200 |
| 2009/0014022 | A1* | 1/2009 | Salciarini | A46B 9/028 132/200 |

(Continued)

FOREIGN PATENT DOCUMENTS

| | | | |
|---|---|---|---|
| EP | 1 169 941 | A1 | 1/2002 |
| FR | 2 900 318 | A1 | 11/2007 |

(Continued)

OTHER PUBLICATIONS

FR3039382A1. De Bardonneche. Translation (Year: 2017).*

(Continued)

*Primary Examiner* — Cris L. Rodriguez
*Assistant Examiner* — Karim Asqiriba
(74) *Attorney, Agent, or Firm* — Oblon, McClelland, Maier & Neustadt, L.L.P.

(57) ABSTRACT

The present invention relates to an applicator for applying a cosmetic product to the eyelashes and/or eyebrows, having an applicator member (8) having: —a core (10) made of polymer material, —at least one bow (12) molded with the core (10), and —a support (21) having two branches twisted around the core (10).

14 Claims, 2 Drawing Sheets

Figure 1:
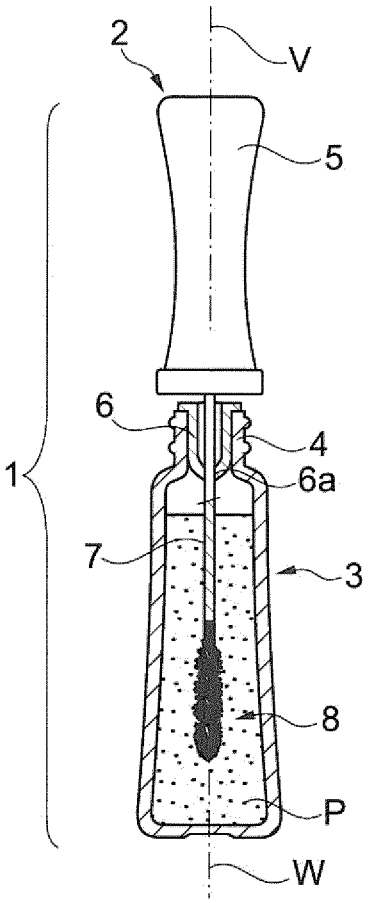

(58) Field of Classification Search
CPC .. A46B 9/06; A46B 9/065; A46B 9/08; A46B 9/10; A46B 9/12; A46B 2200/00; A46B 2200/1046; A46B 2200/1053; A46B 2200/106; A46B 3/18; A45D 40/00; A45D 40/262; A45D 40/264; A45D 40/265; A45D 40/267; A45D 40/268; A45D 34/00; A45D 34/042; A45D 34/043; A45D 34/045; A45D 34/046
See application file for complete search history.

(56) References Cited

U.S. PATENT DOCUMENTS

| | | | | |
|---|---|---|---|---|
| 2013/0104925 | A1* | 5/2013 | Caulier | A46B 9/021 132/218 |
| 2013/0319451 | A1 | 12/2013 | Viegas | |

FOREIGN PATENT DOCUMENTS

| | | | | | |
|---|---|---|---|---|---|
| FR | 2 900 319 | A1 | | 11/2007 | |
| FR | 2 916 328 | A1 | | 11/2008 | |
| FR | 2 936 691 | A1 | | 4/2010 | |
| FR | 2 958 134 | A1 | | 10/2011 | |
| FR | 3 014 656 | A1 | | 6/2015 | |
| FR | 2015083068 | | * | 6/2015 | |
| FR | 2015092586 | | * | 6/2015 | |
| FR | 3 028 396 | A1 | | 5/2016 | |
| FR | 3039382 | A1 | * | 2/2017 | A46B 9/021 |
| JP | 2016-520365 | A | | 7/2016 | |
| WO | WO 02/07559 | A2 | | 1/2002 | |
| WO | WO 2006/090343 | A1 | | 8/2006 | |
| WO | WO 2011/121526 | A1 | | 10/2011 | |
| WO | WO 2014/174424 | A1 | | 10/2014 | |
| WO | WO-2015083068 | A1 | * | 6/2015 | A45D 40/265 |
| WO | WO 2016/075282 | A1 | | 5/2016 | |

OTHER PUBLICATIONS

Japanese Office Action dated Mar. 8, 2021 in Japanese Patent Application No. 20153-563498 (with English translation), 9 pages.
International Search Report dated May 29, 2018 in PCT/EP2018/062224 filed May 11, 2018.

* cited by examiner

APPLICATOR FOR APPLYING A PRODUCT TO THE EYELASHES

TECHNICAL FIELD

The present invention relates to applicators for applying a cosmetic, makeup or care product to the eyelashes or eyebrows, and to packaging and application devices having such applicators.

PRIOR ART

Applicators are known that have an applicator member constituted by a core molded with spikes from a thermoplastic material. One disadvantage of these applicators is linked to the fact that the applicator member must be able to be demo lded, which places limitations on the orientation that the spikes can be given.

Also known are brushes with a twisted core, having two metal branches that enclose bristles between them.

Applicators known as hybrid applicators having a flexible core, for example made of thermoplastic material, bearing spikes, and hairpin-shaped metal branches which enclose the core and are twisted thereon, imparting a twist to the core and causing the spikes to form helical layers, have also been proposed. FR 2 900 318, FR 2 900 319, FR 2 936 691, FR 2 958 134 and FR 3 028 396 disclose applicators at least partially of this type.

Also known, from EP 1 169 941, is an applicator capable of applying a cosmetic product to the eyelashes comprising a perforated support defining at least one opening situated between two opposing regions of the support and projecting elements, which may be formed by teeth or curved bridges of material, connected to at least one of said regions and facing toward the other region.

Also known, from FR 3 014 656, is an applicator for applying a cosmetic product to the eyelashes and/or the eyebrows, comprising an applicator member comprising a core extending along a longitudinal axis, and at least one bow, the ends of which are connected to the core, bearing application elements, and extending in a twist around the longitudinal axis of the core, the distance between the bow and the longitudinal axis of the core, measured at right angles to the core, being variable along the core and passing through a maximum distant from the ends at which the bow is connected to the core.

Objective of the Invention

There is a need to further improve hybrid applicators having a flexible core notably made of thermoplastic material, spikes molded with the core, and a support having two metal branches twisted on the core in order to cause the latter to turn about its longitudinal axis such that the spikes follow a helical path.

SUMMARY OF THE INVENTION

Applicator

Therefore, the subject of the present invention is an applicator for applying a cosmetic product to the eyelashes and/or eyebrows, having an applicator member having:

- a core made of a polymer material, notably a thermoplastic,
- at least one bow molded with the core, and
- a support having two, notably metal, branches twisted around the core.

Within the meaning of the invention, a bow takes the form of a bent stem anchored at its two ends into the core. The bow thus comprises two legs in contact with the core, at the ends of the bow, and an upper connecting part between the two legs. An empty space is thus formed between each bow and the core. The presence of at least one bow makes it possible to have a reserve of product. This is because product can become lodged in the space between the core and the bow.

The applicator member advantageously comprises spikes molded with the core.

The twisted shape imposed by the support allows the spikes to separate to achieve satisfactory combing and separation of the lashes.

The applicator member preferably comprises at least two bows. The bows are advantageously positioned adjacent to one another in at least one row, which extends axially for example along substantially the entire length of the core. In this case, the invention, because of the twisted shape, makes it possible to have bows extending along the twisted core, arranged, one after the other, along a helical line which progresses from a distal end to a proximal end of the core.

Likewise, the spikes may be aligned with one another in at least one row, which extends axially for example along substantially the entire length of the core.

In one particular embodiment, the applicator comprises two, notably diametrically opposed, rows of spikes and two, notably diametrically opposed, rows of bows.

The number of bows per row may be comprised between two and ten, for example be comprised between three and eight, notably be equal to seven.

The bows may have a rounded shape, notably of an arc of a circle. Such an arc of a circle may have a radius of curvature of between 0.5 mm and 4 mm, for example. As an alternative, the bows may have a polygonal shape.

The bows are advantageously positioned so that they are aligned with one another so that just one leg of one bow is adjacent to just one leg of an adjacent bow. According to this preferred embodiment, the bows thus do not form a tunnel and do not face one another. Rather, according to this embodiment, the bows are positioned side-by-side, and in the one same plane before the core is twisted, and then along a helical line once the core has been twisted.

The applicator may comprise at least one relief molded on at least one bow, notably a plurality of reliefs molded on at least one bow. This or these reliefs preferably have a pointed shape, notably with the point facing outward. Such a point may be oriented substantially perpendicular to that part of the bow to which it is connected. The number of reliefs molded on a bow may be greater than two, for example equal to three, preferably equal to four. The number of molded reliefs may vary between two bows. All of the bows may have at least one relief. As an alternative, only certain bows have at least one relief, the other bows having no relief(s).

At least two bows may have dimensions which differ, notably within the one same row. In the latter instance, the bow positioned at at least one end of the row may have a height shorter than that of the bow adjacent to it. Still in this instance, the bows positioned at the two ends of the row may have a height shorter than that of the other bows of the row, which may be of substantially the same height, or even mutually identical.

The bows may be made from the same polymer, notably thermoplastic, material as the core. As an alternative, they are made from another polymer material, being produced for example by two-shot or two-material injection molding or by overmolding.

At least some of the spikes molded with the core, notably all the spikes molded with the core, may be multiple, notably double spikes.

A "spike" denotes an individual projecting element. "Multiple spikes" denotes spikes having at least two branches that extend in divergent directions away from the core, these branches being connected, notably on the core, to one and the same base or having bases that meet or are close to one another. "Bases close to one another" denotes bases, the spacing between which is less than their greatest dimension, measured perpendicular to the axis of elongation of the corresponding branch.

The branches of a multiple spike may occupy the same axial position along the longitudinal axis of the core. The longitudinal axes of the branches of the multiple spike can be contained within one plane, perpendicular to the longitudinal axis of the core.

In the case of a double spike, the two branches of the spike may be symmetrical to each other with respect to a median plane of symmetry containing the longitudinal axis of the core, when this is rectilinear.

The double spikes may each have two branches, the bases of which meet or are at less than 0.8 mm from each other.

The divergent branches of the double spike may form an angle between them.

In an alternative form of embodiment, at least some of the spikes molded with the core are single spikes. The applicator may, for example, in that case, have at least one row of single spikes, or even two rows of single spikes, located opposite one another, between the rows of bows. The single spikes may be rectilinear and extend radially from the longitudinal axis of the core.

The core may define ribs to which the spikes and the bows are connected, these ribs having a height of at least 0.5 mm, better still, at least 0.8 mm. The ribs to which the spikes are connected may have a height less than that of the ribs to which the bows are connected. As an alternative, the ribs to which the spikes are connected have a height greater than or equal to that of the ribs to which the bows are connected.

The ribs of the core may between them define grooves in which the branches of the support extend.

The core can turn by more than one revolution on itself about its longitudinal axis from one end of the applicator member to the other, under the effect of the twist induced by the branches of the support.

The applicator may comprise a stem in which the support is inserted.

The fixing of the support can be effected in a similar way to the fixing of the twisted cores of conventional mascara brushes, for example by thermal insertion of the core in a recess of the stem.

Packaging and Application Device

A further subject of the invention, according to another of its aspects in conjunction with the foregoing, is a packaging and application device, comprising an applicator as defined above and a container containing the cosmetic product to be applied.

Production Method

Yet a further subject of the invention, according to another of its aspects in conjunction with the foregoing, is a method for producing an applicator as defined above, comprising the steps of molding the core, the bows and, where relevant, the spikes in one or more polymer, notably thermoplastic, materials, and twisting the two, notably metallic, branches of the support onto the core in order to cause the latter to deform in torsion about its longitudinal axis.

Makeup Method

Yet another subject of the invention, according to another of its aspects in conjunction with the foregoing, is a method for applying a make up to the eyelashes or eyebrows, in which, in order to apply the make-up product, use is made of an applicator as defined above.

FIGURES

Figure 2:
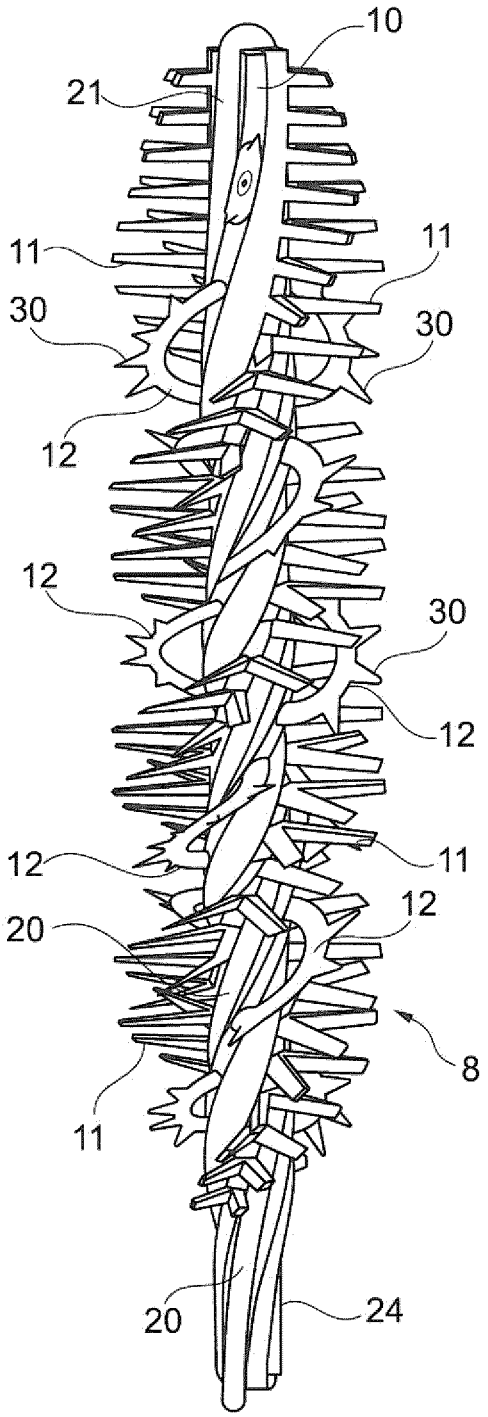
Figure 3:
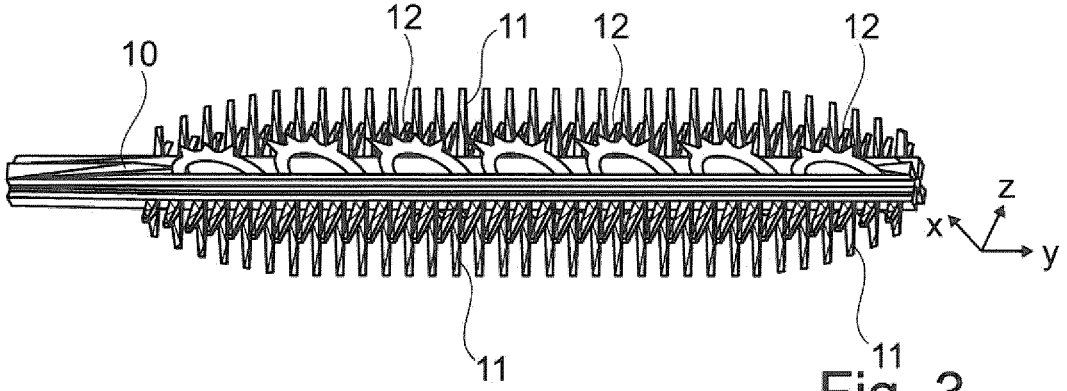
Figure 4:
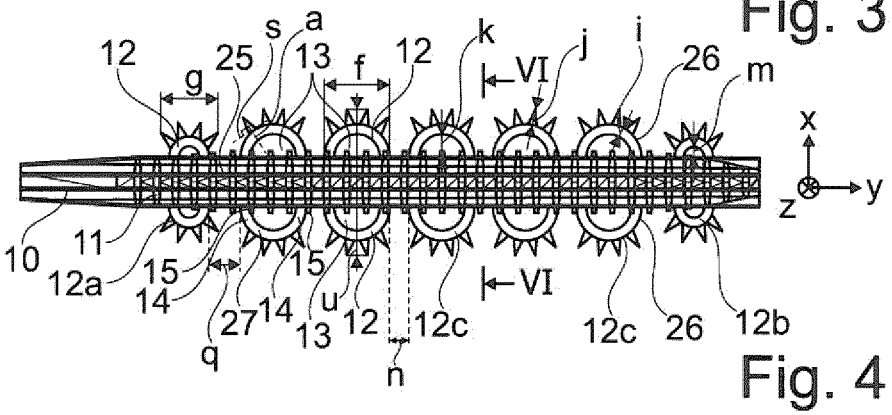
Figure 5:
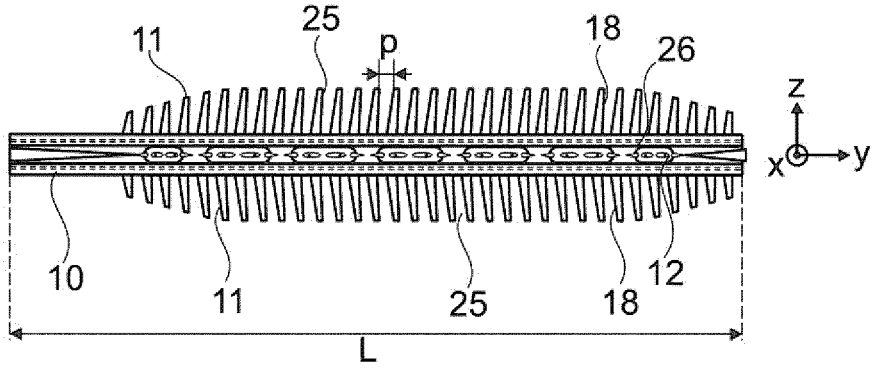
Figure 6:
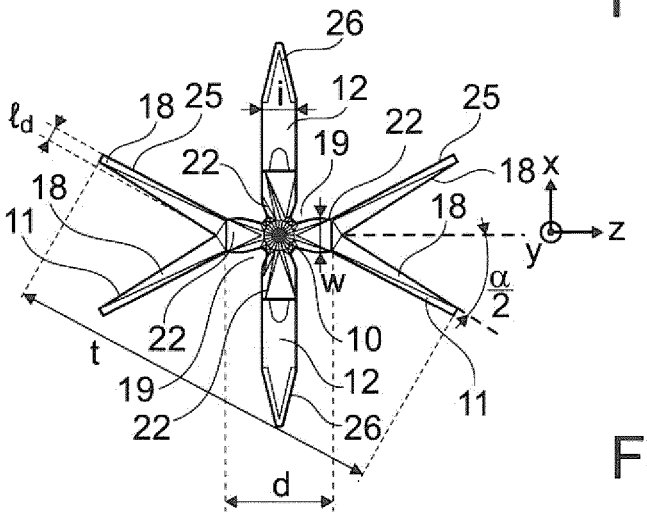

The invention may be better understood from reading the following detailed description of a nonlimiting exemplary embodiment thereof, and by examining the attached drawing, in which:

FIG. 1 schematically shows, in longitudinal section, a packaging and application device according to the invention, FIG. 2 shows just the applicator member of the applicator from FIG. 1, FIG. 3 shows, schematically and in perspective, just the thermoplastic part of the applicator member, before the support is placed thereon, FIG. 4 is a face-on view in the plane (X, Y) of FIG. 3, FIG. 5 is a face-on view in the plane (Y, Z) of FIG. 3, and FIG. 6 is a view in cross section on arrows VI in FIG. 4.

FIG. 1 shows a packaging and application device 1 produced in accordance with the invention, having an applicator 2 and an associated container 3 containing a product P to be applied to the eyelashes and/or eyebrows, for example mascara or a care product.

The container 3 has, in the example in question, a threaded neck 4 and the applicator 2 has a closure cap 5 designed to be fixed on the neck 4 so as to close the container 3 in a sealed manner when it is not in use, the closure cap 5 also constituting a gripping member for the applicator 2.

The applicator 2 has a stem 7 of longitudinal axis V, which is attached at its upper end to the closure cap 5 and at its lower end to an applicator member 8 according to the invention. This applicator member 8 has a thermoplastic part, depicted on its own in FIGS. 3 to 6, and a support 21 having two metal branches 20, visible in FIG. 2, which are twisted on the thermoplastic part and onto one another to form a tail 24 for fixing the applicator member 8 to the stem 7.

The thermoplastic part has a core 10, spikes 11 and bows 12, the spikes 11 and bows 12 extending from the core 10 and all around the latter.

The container 3 has a wiping member 6, for example inserted into the neck 4. This wiping member 6, which may be any wiping member and which is made for example of elastomer, has, in the example in question, a lip designed to wipe the stem 7 and the applicator member 8 when the applicator 2 is withdrawn from the container 3. This wiping lip defines a wiping orifice **6*a* having a diameter adapted to that of the stem 7. The wiping orifice 6*a* can be of circular shape, possibly with slits. The diameter of the wiping orifice 6*a* is for example comprised between 2.5 and 6 mm. The wiping lip 6 may optionally have waves, allowing the wiping orifice 6*a* to widen more easily when the applicator member 8** passes through.

In the example illustrated, the stem 7 has a circular cross section, but it would not constitute a departure from the scope of the present invention if the stem 7 had a different cross section, it then being possible to fix the cap 5 on the container 3 in some other way than by screwing, if necessary.

Preferably, and as in the example in question, the longitudinal axis V of the stem 7 is rectilinear and coincident with the longitudinal axis W of the container 3 when the applicator 2 is in place thereon, but it would not constitute a departure from the scope of the present invention if the stem 7 were not rectilinear, forming for example an elbow. If need be, the stem 7 may have an annular narrowing in its portion that is positioned opposite the wiping lip, so as not to mechanically stress the latter unduly during storage. The stem 7, to which the applicator member 8 is fixed, may also be at least partially, and in particular completely, flexible, notably in the vicinity of the applicator member.

In order to mold the thermoplastic part of the applicator member 8, use can be made of any polymer, notably thermoplastic, material, which may or may not be relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SIS, PET, POM, PU, SAM, PA or PMMA. It is possible notably to use the materials known under the trade names Teflon®, Hytrel®, Cariflex®, Alixine®, Santoprene®, Pebax® or Pollobas®, this list being nonlimiting.

Referring to FIG. 6, it will be seen that the core 10 has a cruciform cross section with four ribs 22 which are arranged in opposite pairs and join at the center of the core 10.

In the example under consideration, the core 10 bears two diametrically opposed rows 25 of double spikes 11 and two more, likewise diametrically opposed, rows of bows 12. Once twisted, as illustrated in FIG. 2, each of the rows of spikes 11 or of bows 12 forms a helical line progressing from one end of the core to the other.

Each bow 12, in the example illustrated and as visible notably in FIG. 4, takes the form of an arc of a circle comprising two legs 14 and a connecting part 27 between the legs 14. Each bow 12 is connected to the rib 22 by the ends 15 of the two legs 14. The bow 12 leaves an empty semicircular space 13 to the core 10, notably the rib 22 of the core 10. This space 13 allows a reserve of product to be formed.

In the example illustrated, the bow 12 comprises, in the connecting part 27, a plurality of reliefs 30, in the example illustrated of pointed shape, with the points facing outward, in a direction a substantially perpendicular to the tangent s to the arc of a circle at which they are connected. The presence of reliefs 30 on the bows 12 may make it possible to afford a combing and separation of the eyelashes, during the application of make up.

In the example illustrated, before the core is twisted, each row 26 comprises seven bows 12, aligned in the row 26 in the same plane, to which the longitudinal axis Y in FIGS. 3 to 6 belongs. These bows are not arranged in such a way as to form a tunnel or an arch, but so that just one leg 14 of one bow 12 is adjacent to just one leg 14 of the consecutive bow 12, as can be seen.

The two bows 12*a* and 12*b* situated at the ends of each row 26 have a height less than that of the other bows 12*c*.

The bows 12*a* and 12*c* each bear four pointed ends 30, whereas the bows 12*b* have just three pointed ends 30. The bows 12*c* are equidistant from one another.

In an alternative form of embodiment which has not been illustrated, all or some of the bows 12 have no reliefs 30.

Each double spike 11 comprises two branches 18 which diverge in the direction away from the longitudinal axis Y of the core 10, forming between them an angle $\alpha$, where $\alpha/2$ is for example equal to 30° as illustrated.

The bases 17 of these branches 18 occupy the same axial position on the longitudinal axis Y of the core, since they are arranged side by side on the rib 22 and meet one another.

The core 10 may exhibit symmetry in a plane (X, Y) and in a plane (Y, Z). The distance d between the tops of the opposing ribs 22 bearing the spikes 11 may be comprised between 2 and 3 mm, for example, of the order of 2.3 mm. The width w of a rib 22 of the core 10 is, for example, comprised between 0.5 and 0.8 mm, being, for example, of the order of 0.6 mm.

The width f of a bow 12*c* may be comprised between 2 and 5 mm, notably be equal to around 3 mm. The width g of an end bow 12*a* or 12*b* may be comprised between 1 and 4 mm, being for example equal to around 1.5 mm.

The distance n between two adjacent bows 12*c* may be comprised between around 0.3 and 1 mm, for example equal to 0.6 mm.

The distance q between the bows 12*a*, 12*c* situated at the ends of each row 26 and an adjacent bow 12*c* is, for example, comprised between 0.3 mm and 2 mm, for example equal to around 1 mm. In the exemplary embodiment illustrated, the stem of a bow has a circular cross section. The diameter i, constant in the example illustrated, of the stem of a bow 12 may be comprised between 0.3 mm and 0.8 mm, being, for example, of the order of 0.5 mm. As an alternative, provision may be made for the stem of a bow to have a cross section that is not circular, for example oval, polygonal, for example square or rectangular.

The pointed ends 30 may be substantially mutually identical and have a height j comprised between 0.5 mm and 1.5 mm, for example equal to around 0.7 mm.

The distance k between the core 10, notably between the rib 22 of the core 10 and the bow 12*c*, is for example comprised between 0.5 mm and 2.5 mm, notably equal to around 1.1 mm. The distance m between the core 10, notably between the rib 22 of the core 10 and the bow 12*a* or 12*b* situated at the ends of each row 26, is for example comprised between 0.2 mm and 1 mm, better between 0.3 mm and 0.8 mm, and notably equal to around 0.5 mm.

The distance u between the ends of the central pointed ends 30 of the bows 12*c* of the two opposite rows 26 is preferably comprised between 5 and 12 mm, for example of the order of 10 mm.

The distance t between the ends of the diametrically opposite branches 18 of two double spikes 11 belonging respectively to the two opposite rows 25 of double spikes 11 is preferably comprised between 5 and 15 mm, and for example of the order of 7 mm.

When the applicator member 8 is observed along its longitudinal axis Y, the width $l_d$ of a double spike 11 at its base is, for example, comprised between 0.05 mm and 0.25 mm, better between 0.1 and 0.2 mm, being for example of the order of 0.15 mm.

Likewise, when the applicator member 8 is observed along its longitudinal axis Y, the width i of a bow 12 is, for example, comprised between 0.1 mm and 0.5 mm, better between 0.2 and 0.4 mm, being for example of the order of 0.3 mm.

The axial distance p between the planes in which two consecutive double spikes 11 within one row 25 of double spikes 11 are situated, is preferably comprised between 0.2 and 1 mm, and, for example, equal to 0.45 mm.

The height of the double spikes 11 can decrease toward the free ends of the core 10.

The total length L of the plastic part of the applicator member 8 is preferably comprised between 10 and 40 mm, and for example equal to around 35 mm.

To produce the applicator member 8, the part thereof made of thermoplastic is first of all molded in the configuration illustrated in FIGS. 3 to 6.

The support 21 is then put in place. The two branches 20 are brought into a U-shaped hairpin shape and engage respectively in the diametrically opposite grooves 19 formed between the ribs 22. Next, by twisting the branches 20, the core 10 is subjected to torsion over more than one revolution about the longitudinal axis Y. The shape depicted in FIG. 2 is obtained, with the rows 25 of spikes 11 and the rows 26 of bows 12 each following a substantially helicoidal path. Because of the combined presence of the bows 12 and of the double spikes 11, reserves of product, and spikes that are directed with orientations very particularly suitable for application of makeup of the eyelashes and/or eyebrows, are obtained on the applicator member 8.

In order to use the device 1, the user unscrews the closure cap 5 and withdraws the applicator member 8 from the container 3.

Once the applicator member 8 has passed through the wiping member 6, a certain quantity of product P remains in the spaces 13 between the bows 12 and the core 10 and in the grooves 19 formed in the core 10 between the ribs 22, creating reservoirs of product along the entire length of the core 10 and on all sides, making it possible to load the eyelashes and/or eyebrows with product P in a satisfactory manner.

Of course, the invention is not limited to the exemplary embodiment just described.

The applicator member 8 may be able to vibrate, that is to say that it is possible to apply vibrations thereto during application, combing or picking-up of the product P, for example as described in application WO 2006/090343.

In a further alternative form of embodiment, the applicator member 8 may be able to rotate, that is to say that it may be made to perform a rotational movement about the longitudinal axis Y of the core 10, for example during application, combing or picking-up of the product P.

In yet another alternative form of embodiment, the applicator member 8 may be heated, that is to say have a heating element for heating the eyelashes and/or eyebrows, and/or the bows 12 and/or the spikes 11 and/or the core 10 of the applicator member 8.

It is also possible for the applicator member 8 to be able to vibrate, to be able to rotate and to be heated, or only to be able to vibrate and to rotate, or only to be able to vibrate and to be heated, or only to be able to rotate and to be heated, or only to be able to vibrate or only to be able to rotate or only to be able to be heated.

The applicator member 8 may comprise any bactericidal agent such as silver salts, copper salts, preservatives and at least one preservative for the product P.

The core 10 and/or the bows 12 and/or the spikes 11 may furthermore comprise particles, for example a filler, notably a compound which is magnetic, bacteriostatic or absorbs moisture, or a compound intended to produce roughness on the surface of the bows 12 and/or the spikes 11 or to help the eyelashes and/or eyebrows slide on these bows and/or spikes. Of the core 10, a bow 12 and a spike 11, at least one may be flocked, undergo any heat treatment or mechanical treatment, and/or comprise particles, for example a filler, in order notably to improve the sliding of the applicator member on the eyelashes and/or eyebrows.

The expression "having a" should be understood as being synonymous with "having at least one", and "comprised between" is understood as including the limits, unless specified to the contrary.

The invention claimed is:

1. An applicator for applying a cosmetic product to eyelashes and/or eyebrows, having an applicator member having:

a core made of polymer material, at least two bows molded with the core, and a support having two branches twisted around the core, said at least two bows being arranged one after the other forming a helical line which progresses from a distal end to a proximal end of the core, the applicator member comprising spikes molded with the core and the core defining ribs to which the spikes and the bows are connected, wherein grooves are located between the ribs to which twisted branches of the support extend, and comprising two diametrically opposed rows of spikes and two diametrically opposed rows of bows.

2. The applicator as claimed in claim 1, wherein the bows are positioned adjacent to one another in at least one row.

3. The applicator as claimed in claim 1, wherein the spikes are aligned with one another in at least one row.

4. The applicator as claimed in claim 1, in which the bows have a rounded shape.

5. The applicator as claimed in claim 1, comprising at least one relief molded on at least one bow, the relief or reliefs having a pointed shape.

6. The applicator as claimed in claim 1, wherein at least two bows have dimensions which differ.

7. The applicator as claimed claim 6, the applicator member comprising spikes molded with the core and at least two bows having different dimensions within one and the same row, wherein the bow positioned at least one end of the row has a height shorter than that of the bow adjacent to it.

8. The applicator as claimed in claim 1, wherein at least some of the spikes molded with the core are multiple spikes.

9. The applicator as claimed in claim 1, the ribs having a height of at least 0.5 mm.

10. The applicator as claimed in claim 9, the ribs between them defining grooves in which the branches of the support extend.

11. The applicator as claimed in claim 1, the core turning by more than one revolution on itself about its longitudinal axis from one end of the applicator member to the other, under the effect of the twist induced by the branches of the support.

12. The applicator as claimed in claim 1, having a stein in which the support is inserted.

13. A device for packaging and application having an applicator as claimed in claim 1, and a container containing the product to be applied.

14. A method for producing the applicator as claimed in claim 1, comprising steps of molding the core, the bows and the spikes in one or more polymer materials and twisting the two branches of the support onto the core in order to cause the latter to deform by torsion about its longitudinal axis.

* * * * *